US005583514A

United States Patent [19]

Fulop

[11] Patent Number: 5,583,514

[45] Date of Patent: Dec. 10, 1996

[54] RAPID SATELLITE ACQUISITION DEVICE

[75] Inventor: Donald G. Fulop, San Jose, Calif.

[73] Assignee: Loral Aerospace Corp., Del.

[21] Appl. No.: 337,754

[22] Filed: Nov. 14, 1994

Related U.S. Application Data

[63] Continuation-in-part of Ser. No. 207,367, Mar. 7, 1994, abandoned.

[51] Int. Cl.[6] ..... H01Q 3/00

[52] U.S. Cl. ..... 342/359; 342/76

[58] Field of Search ..... 342/359, 75, 76

[56] References Cited

U.S. PATENT DOCUMENTS

| | | | |
|---|---|---|---|
| 4,743,909 | 5/1988 | Nakamura et al. | 342/359 |
| 4,801,940 | 1/1989 | Ma et al. | 342/359 |
| 4,823,134 | 4/1989 | James et al. | 342/359 |
| 5,061,936 | 10/1991 | Suzuki | 342/359 |
| 5,173,708 | 12/1992 | Suzuki et al. | 342/359 |
| 5,296,862 | 3/1994 | Rodeffer et al. | 342/359 |
| 5,349,286 | 9/1994 | Babitch | 342/359 |
| 5,351,060 | 9/1994 | Bayne | 343/766 |

*Primary Examiner*—Thomas H. Tarcza

*Assistant Examiner*—Dao L. Phan

*Attorney, Agent, or Firm*—Perman & Green

[57] ABSTRACT

A system and method for acquiring a satellite with an antenna using a computing portion which determines the variation between the actual orientation of the antenna and an optimum orientation to acquire a satellite. The deviation is computed by: determining the actual orientation of the antenna with respect to true North and producing a first signal indicative thereof; determining the location of the antenna on the Earth and producing a second signal indicative thereof; determining the elevation of the satellite with respect to the location of the antenna and producing a third signal indicative thereof; determining the azimuth of the satellite with respect to the location of the antenna and producing a fourth signal indicative thereof; and using log data for the satellite along with the first, second, third, and fourth signals to compute the position of the satellite relative to the antenna and produce a signal indicative of the deviation. A display is used for illustrating the deviation and can be used as a coarse adjustment device. A second display provides information as to the received signal strength from the satellite to the antenna and can be used as a fine adjustment device. The coarse and the fine adjustment devices interact to provide an effective technique to acquire the satellite.

18 Claims, 3 Drawing Sheets

RAPID SATELLITE ACQUISITION DEVICE

CROSS-REFERENCE

This is a continuation-in-part application based on U.S. patent application Ser. No. 08/207,367 filed on 7 Mar. 1994, now abandoned.

BACKGROUND OF THE INVENTION

1. Field of the Invention

The present invention relates to satellite acquisition, and more particularly to a system and technique for rapidly and accurately orienting an antenna to acquire optimum strength signals transmitted from a satellite selected from among a number of satellites available.

2. Problem to be Solved

In order to achieve maximum reception by an antenna of transmissions from an orbiting Earth satellite, it is important that the antenna be aimed directly at the satellite. This process is known in the art as "acquiring the satellite". The specific aiming requirements for different satellites vary, but if the direction in which the antenna is oriented differs from the optimum orientation for acquiring the satellite then suitable reception of the satellite signal by the antenna is not achieved. The acceptable deviation may be no more than a fractional degree in some military satellites and between one and a half and two degrees in some commercial satellites. Even when using antennas designed for satellite television reception, which do not have very demanding accuracy requirements, the antenna must be aimed within a few degrees of the desired satellite in order to achieve adequate reception.

The process of acquiring orbiting satellites is typically slow and tedious, even though there are satellite log books which provide the exact position of these satellites in terms of azimuth and altitude, or alternatively in latitude, longitude and altitude, relative to certain locations on Earth. Since most antennas are not located precisely at these Earth locations, when using such log book information, the person or device that is acquiring a satellite usually has to determine the satellite's position with respect to some other or new location remote from the location selected in the log books, and then align the antenna with the position of the satellite within the specified accuracy. Precise computation of where the antenna is directed relative to the satellite is difficult to perform. It can take a person trained in satellite acquiring a significant portion of an hour to acquire a single satellite when seeking satellites which must be acquired by an antenna within a more limited angular range. For the untrained acquirer, the process is likely to be an exercise in futility. As the process proceeds, the actions of the person attempting to acquire a satellite often become more disjointed, which reduces the probability of success occurring within a reasonable time. Satellite acquisition is one of the primary difficulties associated with satellite antenna usage.

There are many prior art acquisition processes. One of these is referred to as the "step track" acquisition process, in which the user initially coarsely acquires the satellite by orienting the acquiring device in the general direction of an omni-directional beacon signal (ADF) which emanates from the satellite. As soon as the acquirer roughly locates the satellite beacon signal, then some scan technique is used to detect the direction within the coarse acquiring region that the transmission signal from the satellite is most strongly received. Most known step track acquisition processes take a relatively long time to acquire a satellite.

Alternatively, in certain prior techniques, it is known to define a relatively large two dimensional angular range within which the satellite is located. As soon as the outside constraints of the angular range are determined, again some scanning pattern can be applied to determine the region where the satellite signal is received most strongly. Many scanning methods can be used to finely acquire a satellite, such as the stepping, raster-scan, conical-scan, or box-scan techniques.

In these prior art techniques, the original constraints used in coarsely acquiring the satellite are usually so large that a relatively long time is required for the ultimate scan to achieve fine acquisition. It is desirable therefore to more precisely define these constraints so that less time is required for the scan, and/or the scan can be concentrated in a smaller area to yield a more precise satellite signal acquisition.

In another satellite acquiring technique, multiple Global Positioning System (GPS) antennas, with each antenna attached to a distinct GPS sensor, are arranged about the periphery of a platform, such as a table. Each GPS antenna-sensor combination can precisely measure the distance to the satellite being acquired. A computer, with a distance-measuring algorithm, can then use these distances to precisely measure the relative position of the satellite with respect to the platform. With this approach the computer must utilize a relatively complex algorithm to acquire the satellites, and it is also necessary to use a plurality of GPS antennas and sensors.

While the foregoing acquisition processes are especially applicable to geo-stationary satellites, i.e., those with orbits that maintain them above a particuler location on the Earth, it is also possible to use such systems in conjunction with what are called tracking satellites, such as low earth orbit satellites (LEOS), the orbits of which vary their positions relative to the Earth. It is only important that an acquiring system be able to acquire such a satellite at a given time and place. After a tracking satellite is acquired, a tracking system in the acquiring antenna can be used to maintain contact with the satellite. The time constraints presented by tracking satellites, which are only going to be in a certain region of the sky for a relatively short period, makes it even more desirable to be able to quickly acquire these satellites. Similarly, in many other applications, especially many critical military and commercial ones, the acquisition must be achieved within a reasonable period. However, rapid acquisition is unlikely to be reliably achieved using prior art techniques. Therefore, in some applications where satellite communications would be superior to what is presently being used, they are not applied since the acquisition process is uncertain and slow.

From the foregoing considerations, it is apparent that a technique which would achieve rapid and reliable acquisition of satellite transmissions by antennas would be very useful and desirable in many commercial and military satellite applications. Also, an acquisition system would be desirable that is comparatively uncomplicated to operate and readily portable offering versatility of use.

Objects:

It is accordingly an object of the present invention to provide a satellite acquisition system and technique that will rapidly and accurately pick up satellite transmissions with maximum signal strength.

It is a further object of the present invention to provide such a system that is self-contained, without the need for multiple antennas, and capable of being hand-held and of being utilized with any satellite.

SUMMARY OF THE INVENTION

The present invention involves a satellite acquisition system and technique utilizing a computer, in combination with a magnetic flux detector, position sensors and trackers, and stored log data, to determine the deviation between the actual orientation of an earth-based antenna and an optimum orientation for acquiring a satellite. The deviation, when determined, is used to produce an indicative signal that can be represented on a display and used to reorient the antenna, by reducing the deviation signal and thus the deviation, whereby a transmitted signal of maximum strength is received from the satellite. The initial reorientation seeks a coarse minimum deviation and then the variation in the sensed satellite signal strength is used to finely position the antenna to a fine minimum deviation. The computer and associated components may be compactly packaged and the acquisition algorithms are sufficiently simplified and compatible with data change to make the system capable of extremely versatile use.

BRIEF DESCRIPTION OF THE DRAWING FIGURES

Figure 3A:
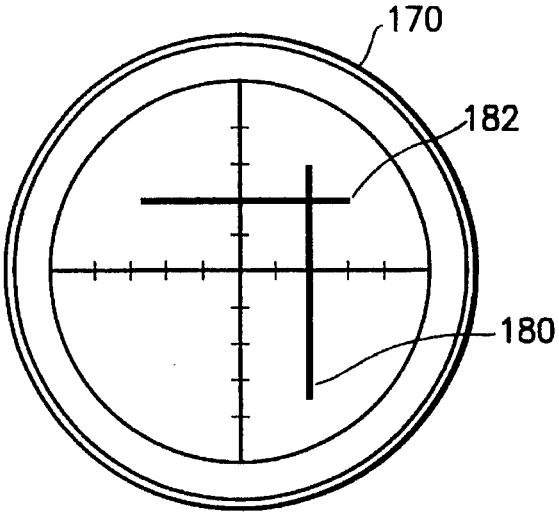
Figure 3B:
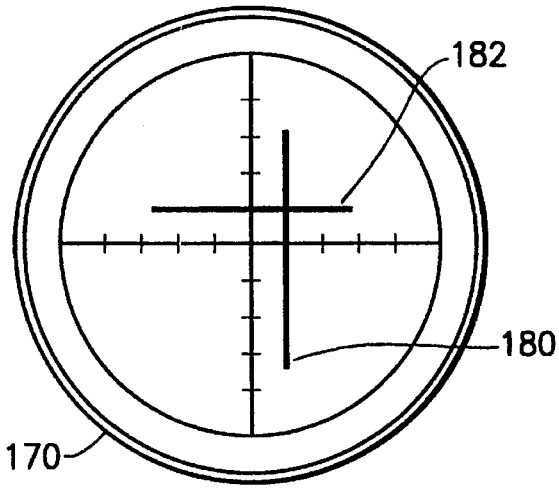
Figure 3C:
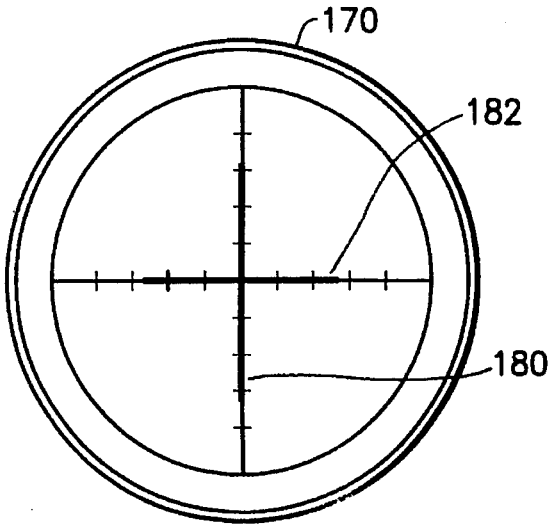
Figure 3D:
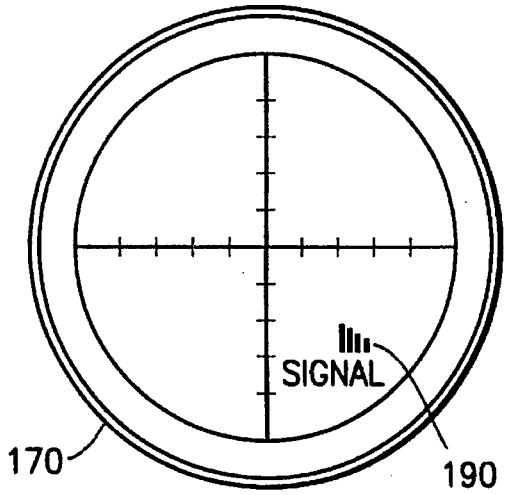
Figure 3E:
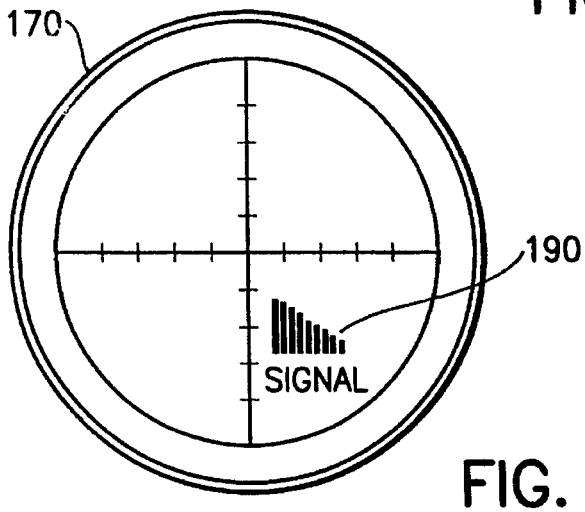

FIG. 3*a* shows a display according to the present invention in a coarse adjustment mode, illustrating the relative position between a present orientation of a satellite antenna and the present position of the satellite, wherein the satellite is oriented above and to the right of an optimum position of the satellite antenna, that is at the center according to the convention of the display;

FIG. 3*b* shows the display of FIG. 3*a*, after the antenna has been somewhat reoriented and with the satellite still above and to the right of, but closer to the optimum position of the antenna than in the FIG. 3*a* configuration;

FIG. 3*c* shows the display of FIG. 3*a*, when the satellite is centered at the optimum position relative to the antenna according to the coarse adjustment, the system now being ready to enter the fine adjustment mode of the present invention;

FIG. 3*d* shows the display of FIG. 3*a*, wherein the display has now entered the fine adjustment mode of the present invention, and the received signal strength from the satellite to the antenna is relatively weak; and FIG. 3*e* shows the display of FIG. 3*a*, wherein the display has now undergone the fine adjustment mode, providing a stronger signal reception than that of FIG. 3*d*.

Figure 4:
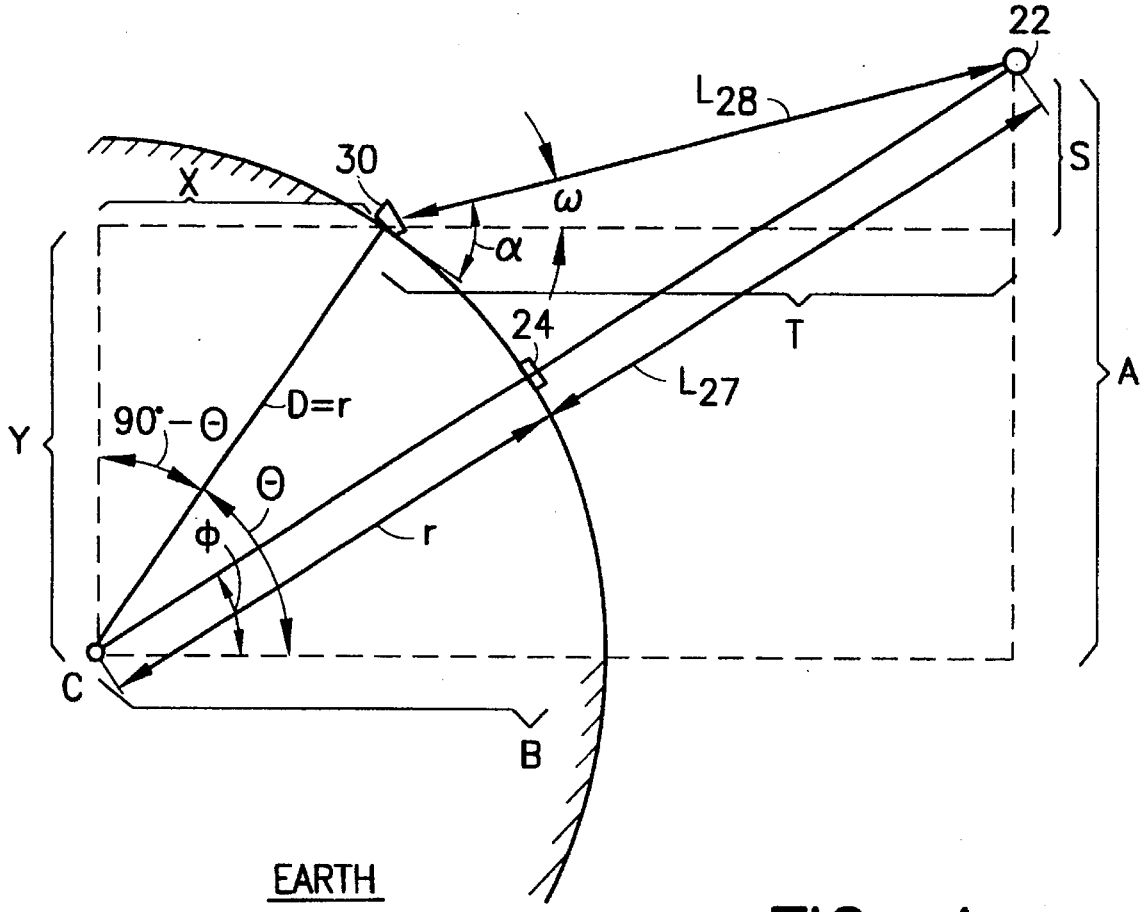

FIG. 4 is a planar geometric diagram illustrating how the angle $\alpha$ of the satellite with respect to the antenna location or new point 30, can be determined.

DETAILED DESCRIPTION OF THE PRESENT INVENTION

Figure 1:
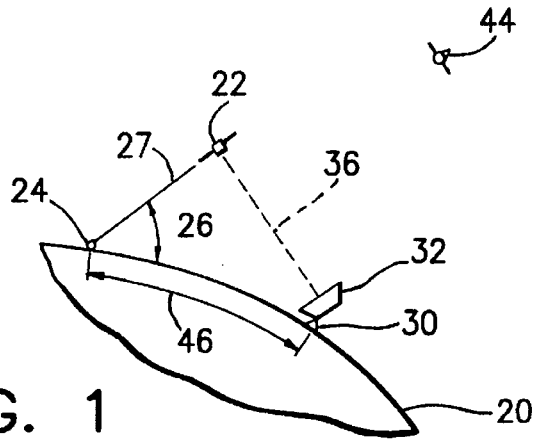
FIG. 1 is a diagram of the geometric relationships involved in acquiring a satellite (22) orbiting above the Earth, when using a satellite log that lists the position of the satellite relative to a known point (24), and when attempting to acquire the satellite with an antenna at a different or new point (30)

FIG. 1 illustrates some geometric relationships by which a satellite's position can be described with respect to different locations on the Earth. A segment of the surface of the Earth is illustrated by the arc 20 with satellites 22 and 44 positioned in orbit above it. The satellites may either be of a geo-stationary type, or of a tracking type (such as a low earth orbit satellite). Satellite logs, either in book form or storable as data in computer memory, are available that indicate the relative positions of orbiting satellites with respect to known points on the Earth's surface, e.g., the position of satellite 22 with respect to known point 24. The position of the satellite 22 relative to the known fixed point 24 is defined in terms of the elevational angle 26 and an azimuth angle (into or out of the plane of the Figure), as well as the distance 27 between the satellite and the point 24. Alternatively, the position of the satellite may be described in terms of appropriate longitude, latitude and elevation information. Satellite logs and their use are well known in the art.

In the typical case of satellite acquisition, an antenna 32, which is going through the process of seeking to receive a signal from a satellite, will be located at a point 30 on the Earth that is displaced or remote from the known point 24. To receive the signal transmitted from satellite 22, it is desired to aim the satellite antenna 32 with an optimum orientation, i.e., with the conical region illustrated by the dotted lines 36, directed at the satellite 22. The optimum orientation is defined as that orientation, when the satellite's transmitter is transmitting at a frequency which the antenna is capable of receiving, that the antenna will exhibit its strongest signal reception. In terms of the Figure, this orientation will occur when the axis of the conical region, indicated by dotted lines 36, is aligned with the direction of the transmitted signal. Each antenna has its own optimum orientation. The greater the angle that a satellite is displaced from the optimum orientation of an antenna, generally the weaker the signal received by that antenna. Thus, one challenge in acquiring a satellite's signal is to align the optimum orientation region 36 of the antenna 32 directly with the satellite 22, as is illustrated in FIG. 1. It will be seen that when the actual orientation of antenna 32 is the optimum or close to the optimum orientation for satellite 22, the possibility that the antenna 32 will receive a signal of any strength from another satellite, such as the satellite 44, is very small.

A consideration which arises from the configuration in FIG. 1 is that, since the values of the elevational angle 26, the relative azimuth angle (not illustrated), and the distance 27 of the satellite 22 relative to the known point 24 (or alternatively the longitude, latitude and elevation of the satellite) are known from the satellite logs, if the direction and the distance 46 between the known point 24 and the location point 30 of the antenna 32 are known, then the position of the satellite 22 relative to the point 30 can be determined geometrically.

An example of the relationships involved in the geometric determination is shown in greater detail in FIG. 4. A computation deriving the attitude and distance to the satellite 22 from the antenna location or new point 30, as compared to the known point 24, begins with obtaining the log book values of the altitude and attitude of the satellite 22 with respect to the known point 24. It is assumed that the following computations are performed in three orthogonal planes, although only the computation along one plane is illustrated. It is further assumed, for convenience of description, that the satellite 22 is located directly above the known point 24 in FIG. 4, since this is often how data is stored in the satellite data logs.

The relational items which are known with respect to the Earth's center C are:

$\phi$=elevational angle of known point 24 and the satellite 22 (log data);

$\Theta$=elevational angle of new point 30 (determined from GPS data);

$L_{27}$=altitude of satellite above Earth's surface (log data); and r=radius of the Earth $$\sin\phi = \frac{A}{L_{27}+r} \quad \cos\phi = \frac{B}{L_{27}+r}$$

where A and B equal the respective vertical and horizontal components of the distance to the satellite 22 taken from the center of the Earth.

$$\sin(90-\Theta) = \frac{X}{r} \quad \cos(90-\Theta) = \frac{Y}{r}$$

where X and Y are respectively the horizontal and vertical component of the distance D (=r) of the new point 30 taken from the center of the Earth, as shown in FIG. 4.

$$S=A-Y=A-[\cos(90-\Theta)r]$$

$$T=B-X=B-[\sin(90-\Theta)r]$$

where S and T are respectively the vertical and horizontal component of the distance $L_{28}$ to the satellite 22 taken with respect to the new point 30 in FIG. 4.

$$\tan\omega = \frac{S}{T} = \frac{A-[\cos(90-\Theta)r]}{B-[\sin(90-\Theta)r]}$$

$$\omega = \tan^{-1}\left\{\frac{A-[\cos(90-\Theta)r]}{B-[\sin(90-\Theta)r]}\right\}; \text{ and}$$

$$\alpha = \tan^{-1}\left\{\frac{A-[\cos(90-\Theta)r]}{B-[\sin(90-\Theta)r]}\right\} + (\Theta-\phi);$$

where $\alpha$ is the apparent angle of the satellite 22 with respect to an observer located at the new point 30.

In order to determine the distance $L_{28}$ from the observer at the new point 30 to the satellite 22, the Pythagorean Theorem is used combining sides S and T:

$$L_{28} = \sqrt{S^2+T^2}$$

$$L_{28} = \sqrt{(A-[\cos(90-\Theta)r])^2 + (B-[\sin(90-\Theta)r])}$$

Even though the relative position of point 30 with respect to the satellite 22 is comprised of both azimuth and elevational angles and the distance to the satellite, it is only necessary to have the azimuth and the elevational angles (and not the distance) to align the antenna 32 in optimum orientation with the satellite 22 in order to achieve maximum reception. This is important since it is sometimes quite difficult to accurately determine the relative distance 46 from the known point 24 to the new point 30 or the relative angle therebetween.

Determining the azimuth and elevational angles of the satellite with respect to the new point 30 can also present quite a challenge. Satellites vary somewhat in position from the data presented in the satellite logs, presenting further problems in acquiring the satellite. These positional uncertainties in large part cause the difficulties in acquiring satellites as noted above in the Background of this specification. The satellite logs are sometimes also arranged in a longitude-latitude-elevation format instead of the format illustrated in FIG. 1. It is important in using any satellite log, that it contain sufficient information to accurately determine the position of the satellite in three dimensions with respect to the known point, such that the geometric equations set forth above can be applied to determine the position of the satellite with respect to the new point or location of the antenna.

Component Description

Figure 2:
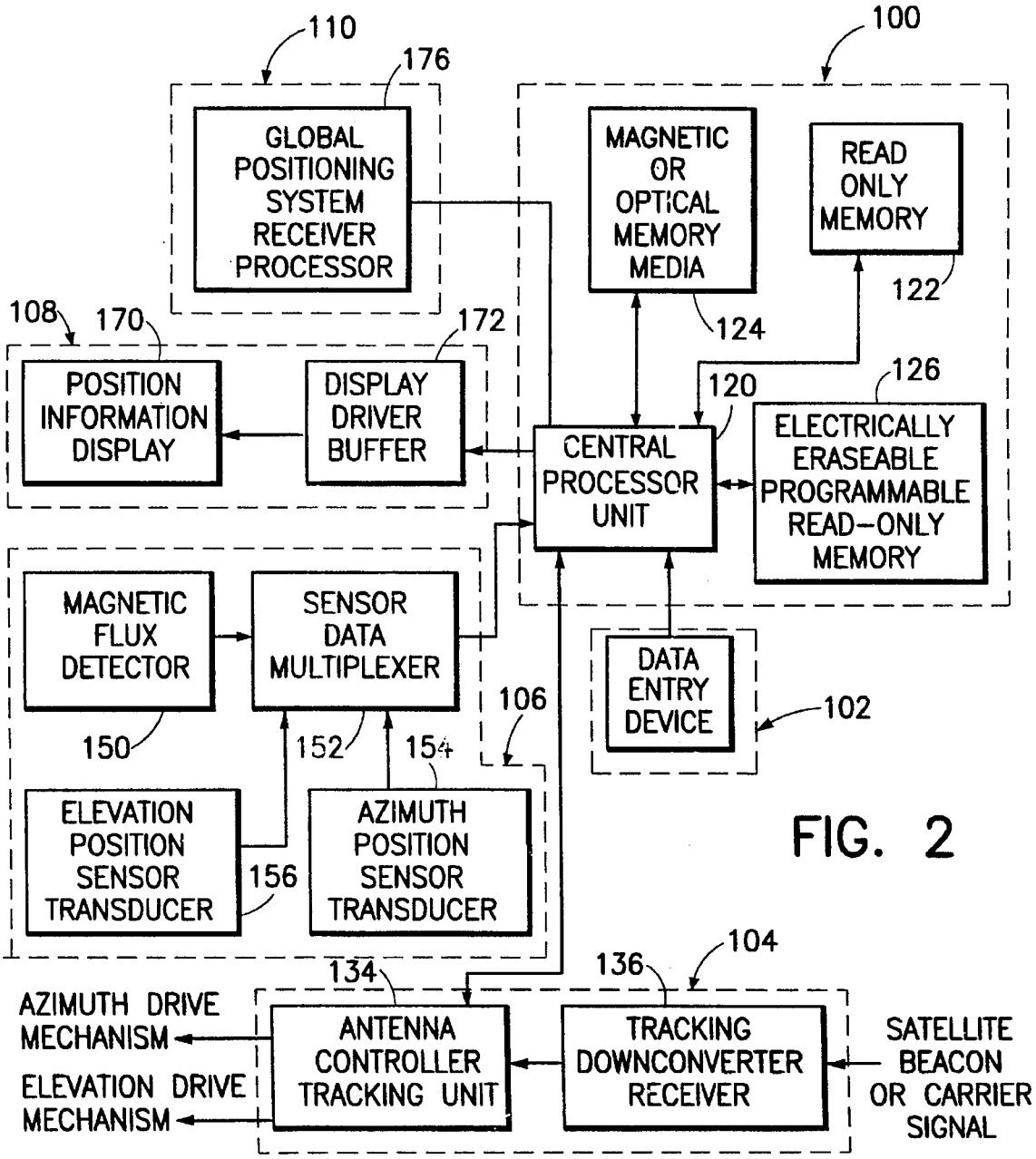
FIG. 2 is a block diagram of one embodiment of a rapid satellite acquiring system in accordance with the present invention.

A preferred embodiment of a system for implementing the invention is shown in FIG. 2 and may be divided into six, or less, portions or modules which act to assist in properly orienting the system antenna. The six portions are: 1) a terminal processing module 100 which interacts with, and acts as a processor for data obtained from, many of the associated modules in order to compute the position of a satellite relative to the new point 30; 2) a data entry module 102 which provides a user of the system a means for inputting data and satellite selections; 3) an antenna tracking module 104 which can, in response to a satellite signal, automatically control displacement of the antenna (or provide appropriate information to a system using an antenna that is manually adjustable); 4) a position obtaining module 106 which provides positional information to the terminal processing portion 100; 5) a display portion 108 that displays an output indicative of the satellite position with respect to antenna orientation, an example of which output is illustrated in FIGS. 3*a*–3*e*; and, 6) a global positioning system (hereafter referred to as "GPS") module 110 which provides an accurate indication of the location of the new point 30 with respect to a global coordinate system. The particular components making up each of these six portions or modules 100, 102, 104, 106, 108, and 110 will now be described.

The terminal processing module 100 contains a central processor unit 120 (hereafter referred to as "CPU"), a read only memory 122 (hereafter referred to as "ROM"), a magnetic or optical memory media 124, and an electrically erasable programmable read only memory 126 (hereafter referred to as "EEPROM"). The CPU 120 may be a standard microprocessor of a type commonly found in portable computers. Since a large amount of processing is not necessary in the present application, any suitable microprocessor, such as an INTEL model "86286" or greater, with 8 bit or larger registers, and a clock speed of 20 MHz or greater, can be used, and should be capable of handling (or multiplexing) seven or more input/output ports. The CPU 120, among other functions, determines which data should be copied or moved between the different modules, or between different components within the terminal processing module 100.

ROM 122 stores the operating system code, application software and positional algorithms for portion 100. Any suitable type of ROM can be used in this application which will contain the geometric formulas, such as set forth above, that are used to convert the satellite log data into the data indicating the position of a satellite with respect to the new point 30 in FIG. 1. The satellite log data itself is contained in the magnetic or optical memory media 124, which offers a means for quickly inputting satellite coordinate data. The media 124 typically is contained on a magnetic floppy disk or optical storage disk, and is read from the disk into the EEPROM 126 via a conventional transport platform. The EEPROM 126 is incorporated to maintain the satellite log look up data, and is a non-volatile memory or data base that can be altered, such as by means of the data entry module 102, in case additions or changes to the satellite log data are desired. The specific information contained within the EEPROM, as alterable memory of the satellite coordinate data, includes sub satellite longitude and latitude, orbital inclination and time, and the satellite designator and position algorithm. All of this information is loaded into the EEPROM from the magnetic or the optical memory media 124 using known techniques.

The data entry module 102 contains a data entry device 130 that is used to enter or alter the satellite log information, and to select the satellite which it is desired to acquire. The data entry device 130 can be an alphanumeric keyboard, an optical scanner, or any other well known applicable data entry device that can be used to provide a desired input to the terminal processing portion 100.

The antenna tracking module 104, will normally be used with automatic tracking systems but a portion can be used with manual tracking systems as well. In manual systems, a mechanical gear assembly is typically used to align the antenna. Thus the output function of module 104 may be performed by human operators, who move the gears based upon information from the terminal processing portion 100. However, as will be seen, information from module 104 may not only be used for coarse adjustment but also may be of assistance in rapidly achieving fine adjustments. In automatic systems, a multi-axis servo-motor configuration (not shown) may be used to align the antenna as desired. The antenna tracking portion 104 contains an antenna controller/tracking unit 134 and a tracking downconverter receiver 136, the operation of which components may be automated and related to the servo-motors. The antenna controller/tracking unit 134 comprises a controller that provides an output to an azimuth drive mechanism and an elevational drive mechanism, which, utilizing the servomotors, position the antenna as desired. Upon initiation of the acquisition process, the antenna controller/tracking unit 134 is controlled by the terminal processing portion 100 which determines the desired position needed for satellite acquisition. After the antenna has been driven to an orientation calculated by the terminal processing portion 100, based upon inputs from ephemeris data (in the satellite logs) and GPS considerations of the location of the new point 30 with respect to the old point 24, the antenna controller/tracking unit 134 switches to a non-GPS based search mode to convert from a coarse to a fine tuning acquisition process and complete tracking of the satellite.

The fine tuning process proceeds and is completed using the tracking downconverter receiver 136, which receives a satellite beacon or a carrier signal as an input and, from the received frequency band, provides a DC signal strength output to the antenna controller/tracking unit 134 to facilitate satellite tracking following completion of the GPS assisted initial acquisition. The tracking downconverter receiver 136 is a commercially available component and its operation is understood by those skilled in the art. The combination of the receiver 136 with the processing module 100 and controller/tracking unit 134 produces an output signal indicative of a desired antenna orientation. In an automatic tracking system this signal can be used to drive the antenna's servomotors, as previously noted; in a manual tracking system the signal may be used to produce an indication to an operator of the direction in which the antenna should be moved.

The position obtaining module 106 is used to provide accurate information as to where the new point (30 in FIG. 1) is located with respect to the old or log point 24, and regarding the azimuth and elevation of a satellite. This module comprises a magnetic flux detector 150, a sensor data multiplexer 152, an azimuth position sensor/transducer 154, and an elevation position sensor/transducer 156. The magnetic flux detector 150 provides an indication of magnetic direction through multiplexer 152 to the terminal processing portion 100. The operation of magnetic flux detectors is well known in aircraft instrumentation, so it will not be described in further detail herein. The magnetic flux detector 150, as applied in the present system, provides magnetic bearing information (functioning similar to a slaved directional gyro that is corrected for magnetic disturbances) for use in the terminal processing portion 100. This bearing information is accurate but uncorrected so that it is combined within the terminal processing portion 100 with the GPS data on the geographic latitude and longitude of the antenna 32 to correct for local magnetic deviation and calculate true magnetic North. True magnetic North is the reference point from which satellite acquisition takes place and may be used to determine the azimuth of the points of interest.

The sensor data multiplexer 152 is used in a fully automatic acquisition system of the type in which an electric drive motor, servo mechanisms, or hydraulics are typically used to position the antenna, and provides azimuth and elevation position data, from transducers 154 and 156, as well as the magnetic flux detection information from detector 150, to the CPU 120. The data is used by the CPU 120 to send a signal to the antenna controller tracking unit 134 to reposition the antenna in seeking acquisition of the satellite.

More particularly, the azimuth position sensor/transducer 154 and the elevation position sensor/transducer 156 provide satellite terminal antenna position information, with respect to a satellite, to the terminal processing portion 100. This position information data is compared with calculated satellite position coordinates within the terminal processing portion 100 by first determining the antenna position at which the strongest signal is received from the satellite using transducers 154 and 156, and then comparing this to the location specified in the satellite logs (ephemeris data) from which the strongest satellite signals should be received. The deviation between these two positions of strongest signal is often indicative of the fact that difficulties in applying an acquisition system are not only due to locations where measurements cannot precisely be made, but also because the satellite's actual position sometimes varies some small amount from it's ephemeris data (satellite logs) position. Based upon the deviation of the actual antenna position relative to the calculated position of the satellite, commands are issued by the CPU 120 to the antenna controller/tracking unit 134 to position the antenna into the desired elevation and azimuth coordinates.

The positional display portion 108 includes a position/information display 170 and a display driver/buffer 172. The position/information display 170 (one embodiment of which is illustrated in FIGS. 3*a* to 3*e*) provides the user with visual positioning information in the form of an azimuth deviation bar 180 (see FIG. 3*a*) and an elevation deviation bar 182. A liquid crystal display (LCD) or a cathode ray display (CRT) is preferred for implementing the positional/information display 170 since it may be desired to alter the form of the display. For example, FIGS. 3*a* to 3*c* illustrate positional type information using the azimuth deviation bar 180 and the elevation deviation bar 182, while FIGS. 3*d* and 3*e* illustrate an informational type display using a histogram 190 of signal strength. While such information could be provided on a more rigid and congested display, the adaptability of the LCD display (preferably back-lit, and super twist) makes it preferred for the present application. It may also be desirable to provide other information on the display 170, such as information identifying the satellite identifier and channel, GPS latitude and longitude, system baud rate, etc., but these are optional. In fully automated systems, the display portion 108 may be used as a monitor to provide an indication that the acquisition process is being performed, or is complete.

The display driver/buffer 172 is incorporated to provide an interface between the terminal processing portion 100 and the position/information display 170. The display driver/buffer 172 converts the serial processor output into the appropriate display control logic signals required for LCD segment illumination. If some other type of display is used, the properties of the display driver/buffer 172 may be altered as appropriate.

The global or ground positioning system (GPS) 110 includes a receiver and a processor 176 and is commercially available from several manufacturers as will be familiar to those of skill in the art. Standard outputs used by the present system include time of day, latitude position and direction, longitude position and direction, and position validity logic. This GPS information is used by the terminal processing portion 100 in determining the positional information on the antenna location 30 that it needs to acquire the satellite. No modification to the standard GPS receiver/processor is required for the present system and, unlike some multi-unit prior art systems, no more that one unit is needed.

Display Portion Display, And Associated Operation

FIGS. 3*a* to 3*e* illustrate the images on the position/information display 170 during different portions of the acquisition process in accordance with the invention. FIGS. 3*a* to 3*c* illustrate the appearance of the display during the course adjustment segment, where the user is attempting to align the optimum orientation axis 36 (see FIG. 1) with the actual position of the satellite 22. Log information on the satellite's position with respect to the known point 24 is stored in the magnetic or optical memory medium 124 and pertinent segments are read, at a given time, into the EEPROM 126 by the CPU 120. The present position of the antenna 32 (which is located at the new point 30) is determined from the GPS receiver processor 176, which can determine the new point's location on the Earth extremely precisely. The position of the satellite 22 relative to the antenna 32 is determined during coarse acquisition by: 1) determining where the satellite 22 is relative to the known point 24 on the Earth using data in memories 124, 126; 2) determining where the new point 30 is on the Earth using the GPS receiver/processor 176; and then calculating geometrically the satellite's position from the new point 30, using the magnetic data and the geometric formulas of ROM 122 (in the manner generally described above). The display 170, using the coarse adjustment techniques, will provide visual information as to how far the optimum orientation is from the actual orientation. At this point, considering that the coarse adjustment technique will not provide a completely acquired satellite, a fine adjustment technique is then used to more precisely acquire the satellite. While the user display 170 is not absolutely necessary in acquiring the satellite in automatic systems, it is important that the user be able to determine how well the acquisition process is progressing. This is true especially in the fine acquisition process when the user is not always certain that the satellite has been fully acquired.

The operation of the acquiring system of FIG. 2 utilizing display system images as shown in FIGS. 3*a* to 3*e* will now be described. FIGS. 3*a* to 3*e* represent sequential steps in the acquisition process. FIG. 3*a* illustrates the position/information display 170 having elevation deviation bar 182 and azimuth indication bar 180 positioned thereon with respect to the optimal crossing point 185 and indicating that the antenna is directed above and to the right of the required position for optimal orientation. Accordingly, the user of the antenna manually, or the antenna tracker 104 automatically, begins to coarsely adjust the antenna in such a direction that the FIG. 3*b* display results. Coarse adjustments differ from fine adjustments in the speed and accuracy by which the antenna is physically moved. Antenna movement is preferably facilitated using either a mechanical linkage arrangement for manual systems, or a servo motor for electronic systems. The coarse alignments are also controlled by GPS positioning techniques (to coarsely acquire the satellite) until the bars 180 and 182 appear on the display as shown in FIG. 3*c*. The fine adjustments are then controlled by a received signal strength maximizing algorithm which produces the images shown in FIGS. 3*d* and 3*e*.

In observing the displayed images as shown in FIGS. 3*a* and 3*b*, the user (or the program) will observe how quickly the positions of elevation deviation bar 182 and the azimuth indication bar 180 change. The changes result from the adjustment in the position of the antenna accomplished by signals from the tracking down converter receiver 136 and the antenna/controller tracking unit 134. This will provide an indication of the sensitivity of the adjustment. The user or system will continue to adjust the antenna along both axes until the display appears as illustrated in FIG. 3*c*, where the actual and the calculated optimal orientations coincide exactly, i.e., the deviation signal goes to a minimum or zero. Using the coarse adjustment technique, FIG. 3*c* is the best that can be achieved. When the FIG. 3*c* display is achieved, the user (or the processor if the system is automated) will alter the mode of adjustment from the coarse adjustment technique to the fine adjustment technique.

FIG. 3*d* illustrates the first display to be used in the fine adjustment technique. The elevation indication bar 182 and the azimuth indication bar 180 of FIG. 3*c* are replaced by the histogram 190 of FIG. 3*d*. None of the amplitudes in the histogram 190 of FIG. 3*d* appear very strong. The histogram provides an indication of the actual signal received by the antenna from the satellite, i.e., the beacon or carrier signal, at different frequency bands. The strengths of certain of the frequency bands are used to determine the strength and identity of the signal. As the antenna is finely adjusted, the strengths of the histogram will change. As noted above, one goal of satellite acquisition is to maximize the received signal, and this will be accomplished when the histogram appears as illustrated in FIG. 3*e*, using the fine adjustment technique described.

The fine acquisition process involves adjusting the orientation of the antenna to receive a maximum strength signal from the satellite. For most non-automatic acquisition systems, as soon as the coarse adjustment technique is complete, the antenna will be positioned to receive a strong signal. At this point, it is important not to move the antenna too radically to avoid moving the optimum axis of the antenna to a position where the antenna is no longer receiving a signal from the desired satellite. Hence, the adjustments should remain small, and the fine adjustment technique is carried out by moving the antenna in whichever direction makes the received signal from the satellite stronger, and moving it in that direction until the signal strength begins to drop. The antenna is then returned to the position where the strongest signal was received. The signal strength may be sensed by sensors/transducers 154 and 156. This technique is performed along both axes of orientation, and may be repeated along each axis alternately until such time as moving the antenna in any direction reduces the strength of the signal. It can be performed manually by moving the antenna by hand while monitoring the signal level of the histogram 190 on the display 170 (see FIGS. 3*c* and 3*d*), or be performed by automating the process using the tracking downconverter receiver 136.

Since a satellite's position may vary somewhat in orbit, in certain very precise applications it may be necessary to continually reacquire the satellite and reposition the antenna to maintain strong signal reception. In most geo-stationary applications, however, once the antenna acquires the satellite, the satellite will not move far enough from an acquired position to make it worthwhile readjusting the antenna.

It will be seen that the necessary portions and components of the system of the invention may be suitably selected, assembled, and packaged in a compact manner, and as multiple GPS antennas are not needed, the system may be readily portable for operation at various locations. Further, since the data in the processing portion 100 may be easily changed and updated, and a flux detector determines true magnetic deviation, the system is capable of acquiring any satellite a user may select. Also, no complicated search algorithms are used in the processing so that rapid and accurate acquisition is facilitated. With the addition of a visual display of the acquistion process to the other components, the system offers complete versatility of use.

It should be understood that the foregoing description is only illustrative of the invention. Various alternatives and modifications can be devised by those skilled in the art without departing from the invention. Accordingly, the present invention is intended to embrace all such alternatives, modifications and variations which fall within the scope of the appended claims.

What is claimed is:

1. In an apparatus for acquiring a satellite using antenna means for receiving transmitted signals from Earth-orbiting satellites, which antenna means has an optimum orientation wherein the strength of the received signals is strongest, the improvement comprising:

GPS means for determining the position of said antenna means with respect to known Earth coordinates and producing positional signals indicative thereof;

magnetic means for determining the actual orientation of said antenna means with respect to true North and producing first orientation signals indicative thereof;

means for determining the present orientation of said antenna means relative to said satellite and producing second orientation signals indicative thereof;

computing means, utilizing satellite log data, and responsive to said positional signals and said first and second orientation signals, for determining the deviation of the present orientation of said antenna means from an optimum orientation for said antenna means at which it is substantially aligned with said satellite, and for producing a signal indicative of said deviation; and means, responsive to said deviation signal, for reorienting said antenna means to reduce said deviation signal.

2. An apparatus as in claim 1 further comprising:

display means for illustrating the actual orientation of said antenna means relative to said optimum orientation.

3. An apparatus as in claim 2, further comprising:

coarse adjustment means for altering said actual orientation to said optimum orientation based upon indications on said display means.

4. An apparatus as in claim 2, further comprising:

fine adjustment means for providing finer adjustment as the optimum orientation becomes closer to the actual orientation based upon indications on said display means.

5. An apparatus as in claim 2, further comprising:

signal strength reception means for determining the strength of signals received by said antenna means from said satellite and producing signals indicative thereof.

6. An apparatus as in claim 5, further comprising:

a coarse adjustment means for altering said actual orientation relative to said optimum orientation based upon indications on said display means; and a fine adjustment means for altering said actual orientation relative to said optimum orientation based upon indicative signals from said signal strength reception means.

7. An apparatus as in claim 2, wherein said display means further comprises:

an elevation deviation bar and an azimuth deviation bar.

8. An apparatus as in claim 1 further comprising:

signal strength reception means for determining the strength of signals received by said antenna means that have been generated by said satellite and producing signals indicative thereof.

9. An apparatus as in claim 8, further comprising:

adjustment means for altering the orientation of said antenna means based upon said indictive signals from said signal strength reception means.

10. An apparatus for acquiring transmitted signals from Earth-orbiting satellites using an antenna having an optimum orientation wherein the strength of the received signals is strongest, comprising:

magnetic means for determining the actual orientation of said antenna means with respect to true North and producing a signal indicative thereof;

global positioning system means for determining the location of said antenna means on the Earth and producing a signal indicative thereof;

means for determining the elevation of said satellite with respect to the location of said antenna means and producing a signal indicative thereof;

means for determining the azimuth of said satellite with respect to the location of said antenna means and producing a signal indicative thereof;

computing means, having log data for said satellite stored therein and responsive to signals from said magnetic means, said global positioning means, said elevation determining means, and said azimuth determining means, for determining the deviation between the actual orientation of said antenna means and an optimum orientation in which said antenna means is substantially aligned with said satellite, and producing a signal indicative thereof; and means, responsive to said deviation indicative signal from said computing means, for reorienting said antenna means to reduce said deviation and orient said antenna means at said optimum orientation.

11. An apparatus as in claim 10, further comprising:

display means, responsive to said deviation indicative signal, for displaying the deviation between said actual orientation and said optimum orientation of said antenna means.

12. The apparatus as in claim 11, wherein said display means further comprises:

means for illustrating the actual orientation of said satellite relative to said optimum orientation comprising an elevation deviation bar and an azimuth deviation bar.

13. The apparatus as in claim 11 further comprising:

signal strength reception means for determining the strength of signals received by said antenna means that have been generated by said satellite and producing signals indicative thereof;

and wherein said display means further comprises:

means, responsive to said signal strength signals, for illustrating the strength of said received signals in a histogram.

14. A method for acquiring a satellite with an antenna having an optimum orientation at which transmitted signals from Earth-orbiting satellites are received with the greatest strength, comprising the steps of:

using a GPS means for determining the position of said antenna with respect to known Earth coordinates and producing positional signals indicative thereof;

using magnetic means for determining the actual orientation of said antenna with respect to true North and producing first orientation signals indicative thereof;

determining the present orientation of said antenna relative to said satellite and producing second orientation signals indicative thereof;

computing, utilizing satellite log data, said positional signals and said first and second orientation signals, the deviation of the present orientation of said antenna from said optimum orientation for said antenna at which it is substantially aligned with said satellite, and for producing a signal indicative of said deviation; and reorienting said antenna to reduce said deviation signal to a minimum.

15. The method as in claim 14, wherein said computing step further comprises the step of:

providing a display, responsive to said deviation signal, for indicating the deviation between said actual orientation and said optimum orientation of said antenna to receive a signal from said satellite;

and said reorienting step comprises:

repositioning said antenna to reduce said deviation indicated on said display.

16. The method in claim 15, wherein the deviation between said actual orientation and said optimum orientation of said antenna is illustrated by an elevation deviation bar and an azimuth deviation bar.

17. The method as in claim 15, further comprising the steps of: .

determining from said display when said deviation is reduced to a coarse minimum;

monitoring the strength of a signal transmitted from said satellite and received by said antenna; and finely repositioning said antenna until the strength of said signal is maximized and said deviation is reduced to a fine minimum.

18. The method in claim 17, wherein the monitoring step comprises illustrating the strength of the signal transmitted from said satellite by a histogram.

* * * * *